US005810510A

United States Patent [19]

Urriola

[11] Patent Number: 5,810,510

[45] Date of Patent: Sep. 22, 1998

[54] UNDERGROUND DRAINAGE SYSTEM

[76] Inventor: Humberto Urriola, 55 Romney Road, St. Ives, NSW, Australia, 2075

[21] Appl. No.: 663,042

[22] PCT Filed: Dec. 14, 1994

[86] PCT No.: PCT/AU94/00771

§ 371 Date: Jun. 14, 1996

§ 102(e) Date: Jun. 14, 1996

[87] PCT Pub. No.: WO95/16833

PCT Pub. Date: Jun. 22, 1995

[30] Foreign Application Priority Data

Dec. 14, 1993 [AU] Australia ..... PM2944

[51] Int. Cl.[6] ..... E02B 11/00; E02B 13/00; E02B 3/16; E03B 7/00

[52] U.S. Cl. ..... 405/45; 405/43; 405/36; 210/170; 137/236.1

[58] Field of Search ..... 405/36, 43, 45; 210/170; 137/236.1

[56] References Cited

U.S. PATENT DOCUMENTS 5,727,901 3/1998 Rennie et al. ..... 405/45

*Primary Examiner*—Tamara L. Graysay
*Assistant Examiner*—Gary S. Hartmann
*Attorney, Agent, or Firm*—Townsend and Townsend and Crew LLP

[57] ABSTRACT

An underground drainage system comprising piping and storage tanks (4) made from perforated wall modules (8) to form the desired size and configuration, which is wrapped in a water permeable geotextile (9). The system is preferably buried in clean sand (10 ), whereby rainwater and runoff water is directed to flow through the water permeable geotextile (9) through the perforated wall modules (8) and into the piping (4) where the thus filtered water can travel along the piping (4) to flow back through the walls of the piping (4) into the first available strata where the surrounding ground is not saturated.

8 Claims, 11 Drawing Sheets

UNDERGROUND DRAINAGE SYSTEM

BACKGROUND OF THE INVENTION

1. Field of the Invention

The present invention relates to a drainage system and in particular to such a system designed to not only collect excess water, but to return purified water to the environment as close to the point of collection as possible. The aerated and pure water allows aerobic neg-entropic activities in the soil horizon both above and in the drainage strata itself.

2. Description of the Prior Art

For many centuries the development of land has involved installation of drainage infrastructure commencing with collection points such as gutters and downpipes, curbing and guttering, grates and sumps, open or enclosed troughs and canals, detention ponds and others. These primary collection points lead in turn into pipes which in turn feed large pipes or stormwater canals which in turn lead eventually to creeks and rivers and finally the sea. This existing method, with its concentration of runoff and resultant depletion of the oxygen content of the water, is one of the major causes of water contamination and depletion of flora and fauna on the planet since Roman times.

The continuing urbanization of the natural countryside which replaced permeable topsoil with impervious surfaces disturbs, alters and contaminates the natural surface water and groundwater tables, and results in a dramatic increase in contaminated surface runoff with resulting floods both minor and major, as water which would normally have been absorbed by the soil and flora is concentrated in man-made impermeable channels where the oxygen content of the water is greatly decreased from that of the water in the natural environment.

Water entering into these impermeable anaerobic systems undergoes entropic degradation as much litter, oil and other impurities find their way into the system, often via curbsides. The oxygen content of the water, which is lowered by mixing organic matter and pollutants, also continually decreases as it passes through the system towards the river or sea.

The accumulation of rubbish and silt in the drainage systems causes the formation of stagnant anaerobic pools which can be breeding grounds for mosquitos and diseases, especially in open drainage channels.

Much silt and soil also finds its way into drainage systems, and furthermore the additional burden on creeks and rivers causes yet further erosion, resulting in disastrous siltation lowering of oxygen content of rivers, lakes and eventually the sea. This is a major ecological problem of today.

Sportfields are becoming major offenders in ecology. Playing surfaces are becoming unplayable due to the imbalance of water in the first soil horizon. Too much or not enough water result in the degradation of the physical structure of the soil. The resultant retardation of the vegetation induces the use of large amounts of chemicals as a solution to keep the fields grassed. However, this increases the contamination of the runoff water.

When one compares the above-mentioned undesirable situation with the natural undeveloped situation, it can be seen that far larger volumes of runoff are being transported far greater distances at an increasing rate. In natural systems, rainwater is filtered through the ground, maintaining a healthy oxygen content, and is being continually cleansed by such filtration through the soil, sand and rock strata and transport slowly by aquifers.

SUMMARY OF THE INVENTION

It is consequently an object of the present invention to more closely emulate natural drainage patterns by provision of an underground system which provides not only for collection and transport of stormwater, but also for return of the stormwater to the environment through porous surfaces at a locality as close as possible to the point of collection.

In one broad form the invention comprises a system comprising storage and/or piping made from module wall panels, said panels having perforations thereon. In use, the panels are assembled to form the storage and/or piping, and are then wrapped in a geofabric such that water can flow into and out of the storage and/or piping through the wall panels.

The invention provides an underground drainage system comprising storage and/or piping which are made of porous materials to allow water to flow in all directions through the material such that, in use, water permeates from said storage and/or piping into the surrounding earth. Hence, embodiments of the present invention have the ability to alter the disruption of the natural water by replacing the impervious entropic man-made systems with a neg-entropic natural system, with resulting improvement in quality of flora and fauna.

Permeable topsoil or surface structures with small compaction coefficients are important to ensure water penetration into the system. In preferred embodiments of the present invention, aerobic drainage electrostatically positions soil fines above hydrophilic geotextile, which surround storage/piping of the present invention. Fine matter is repelled and replaced by larger particles allowing clean oxygenated water to pass therethrough, thus improving drainage capabilities. This will stop the normal size stratification of soil and thus create the necessary conditions for healthy and fast growth of flora and the resultant proliferation of fauna. Plants thus have the ideal soil conditions, without the need of artificial fertilizer. Fauna and flora proliferate naturally in a balanced manner.

DETAILED DESCRIPTION OF THE PREFERRED EMBODIMENTS

During rain, because of the extensive use of bitumen, concrete and buildings, the natural absorption of water into the soil is limited to small areas of parks and gardens.

With existing systems, rainwater flows across the roadways and footpaths, which are made of water impermeable material, and into gutters through gratings into underground impervious piping. As is obvious, the runoff carries rubbish through the gratings into the piping. Usually the piping connects with larger diameter piping or open stormwater or drainage channels.

Existing open stormwater channels and underground piping are usually constructed to carry the excess runoff to a large body of water such as a lake or the sea. The concrete walls of the conventional open drainage channel are open, allowing the entrance of natural organic waste such as leaves, bodies of animals and soil as well as man-generated wastes such as plastics. This material is collected along the entire length of the drain and is deposited in the river systems or finally the sea.

Because of the high concentration of organic material, oxygen is depleted from this water and this, together with the entrained silt and other pollutants, degrades our river systems.

As the concrete walls and the impervious piping are substantially impervious to water, water is carried away from the environment, where it enters the channel with minimal opportunity of water entering the immediate groundwater.

Further, these open channels accumulate litter and silt, as well as stagnant pools of water which are ideal breeding grounds for mosquitos, rats and other vermin, and disease. Large and deep open stormwater channels also are a danger for small children and animals, as well as a potential hazard for vehicular traffic.

Even in the case of an enclosed drainage system utilizing underground pipes, silt, rubbish and pollutants are swept into the pipes via gutter collection points such as drains, and the oxygen content of the water is lowered and entrained pollutants are again flushed into our river systems. The concentration of flow by the conventional drainage systems is a major cause of flooding in low areas of the city.

Figure 1:
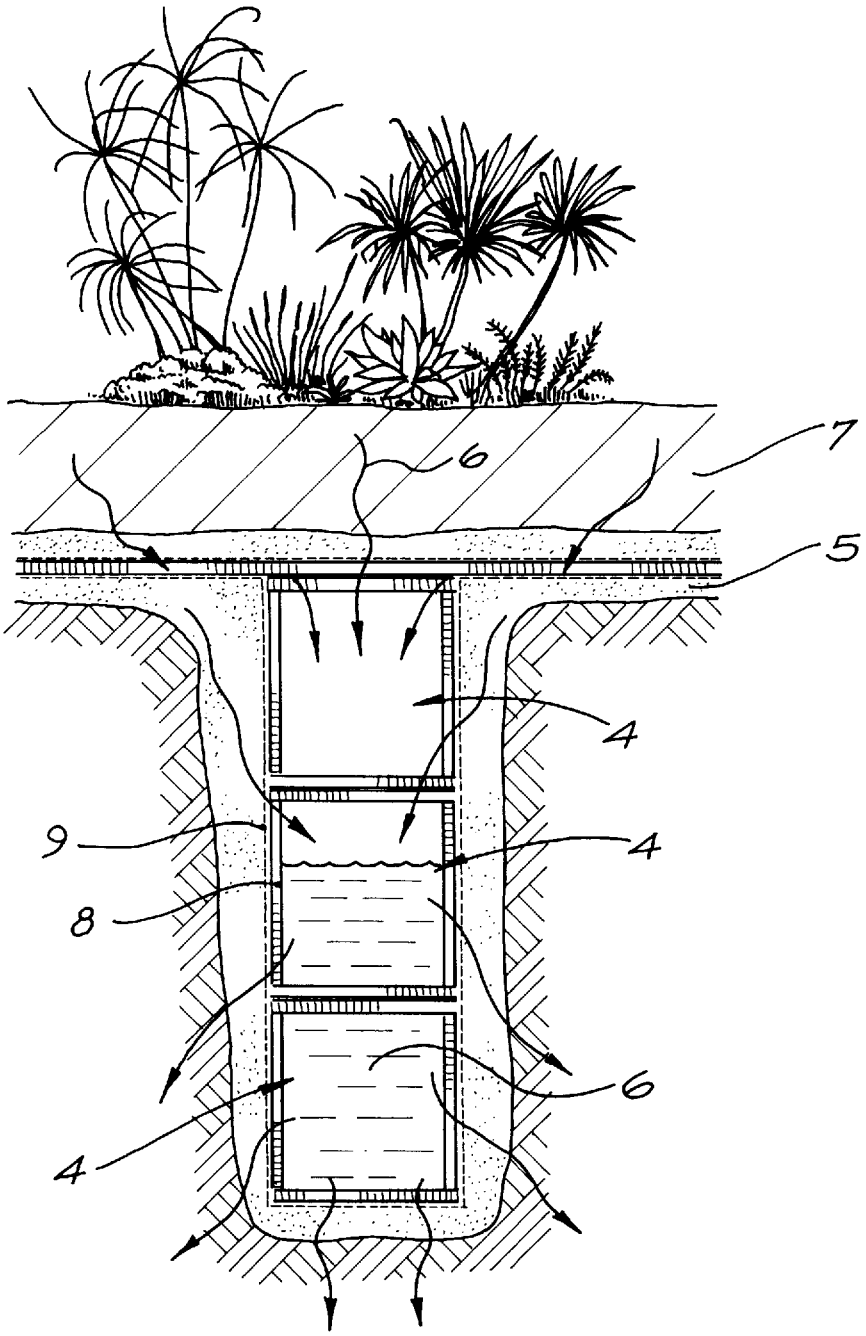
FIGS. 1, 2 and 3 illustrate cutaway views of drainage systems according to embodiments of the present invention.
Figure 2:
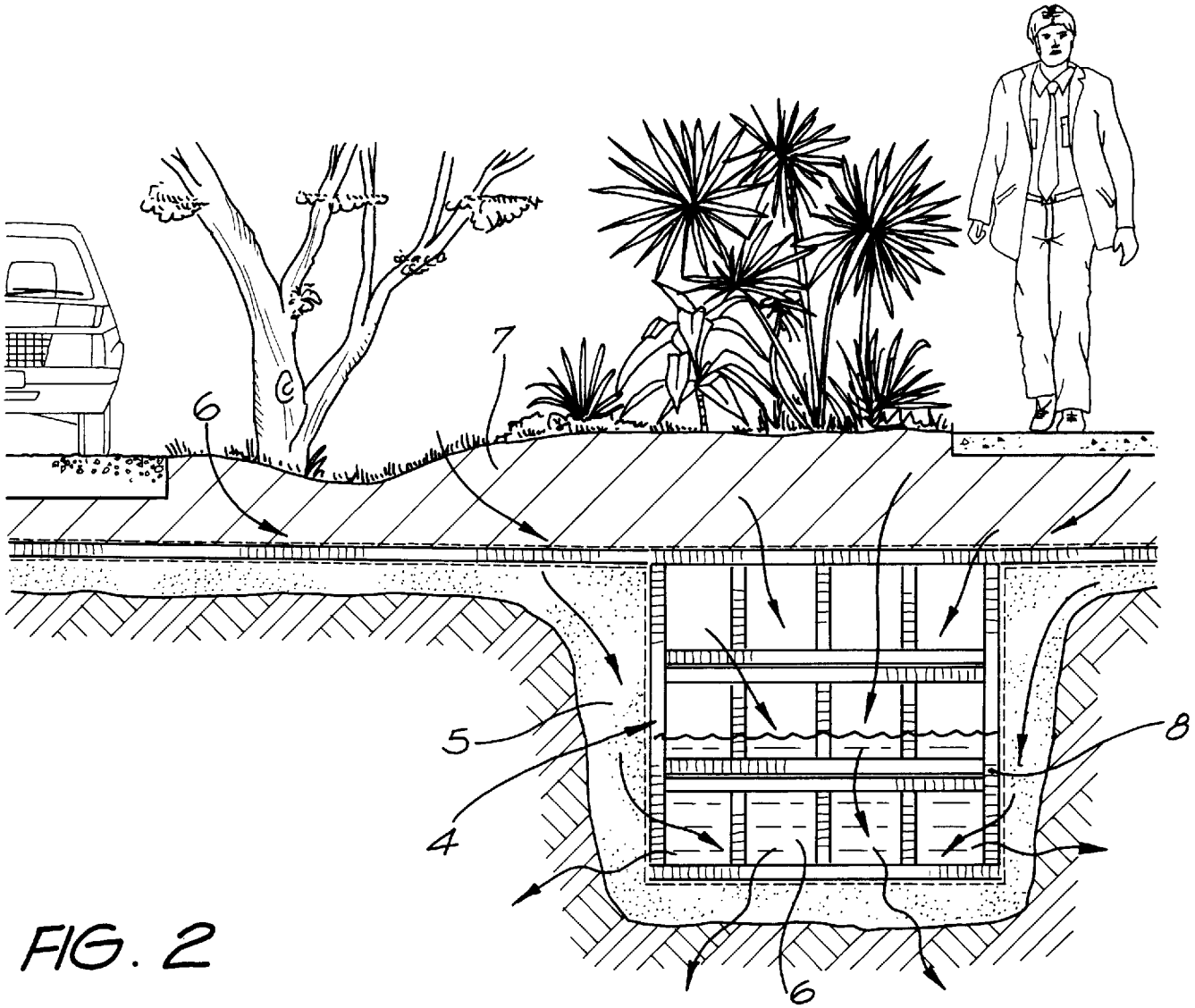
Figure 3:
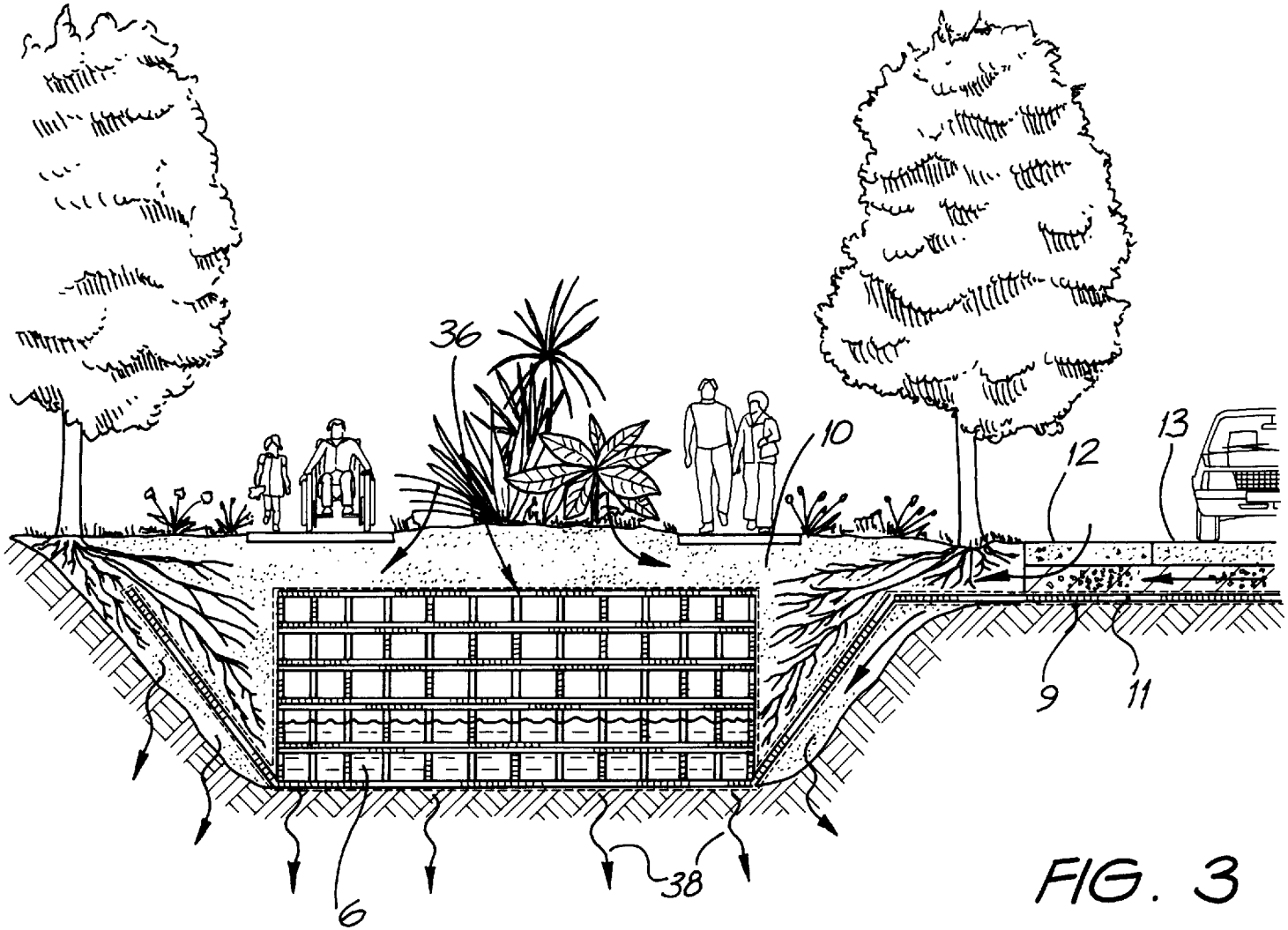

Embodiments of the present invention such as those shown in FIGS. 1, 2 and 3 filter out solids from the water and lessen the reduction of oxygen from the water contained in the pipes of the present invention as compared to the conventional stormwater channels, due to roughness of the wall surface and the resultant turbulence.

The embodiment shown in FIG. 1 comprises three layers of porous pipes or tanks (4) buried in a layer of sand (5). Because of the porous nature of the pipes or tanks, water (6) passes from the topsoil (7) into the pipes or tanks (4) where it accumulates or flows to the required collection point. The water can readily flow from the upper pipe to the lower pipe, and out through the walls of the pipe into the groundwater, along the length of the pipe. Any water that travels the length of the pipe is filtered and oxygenated.

Figure 4:
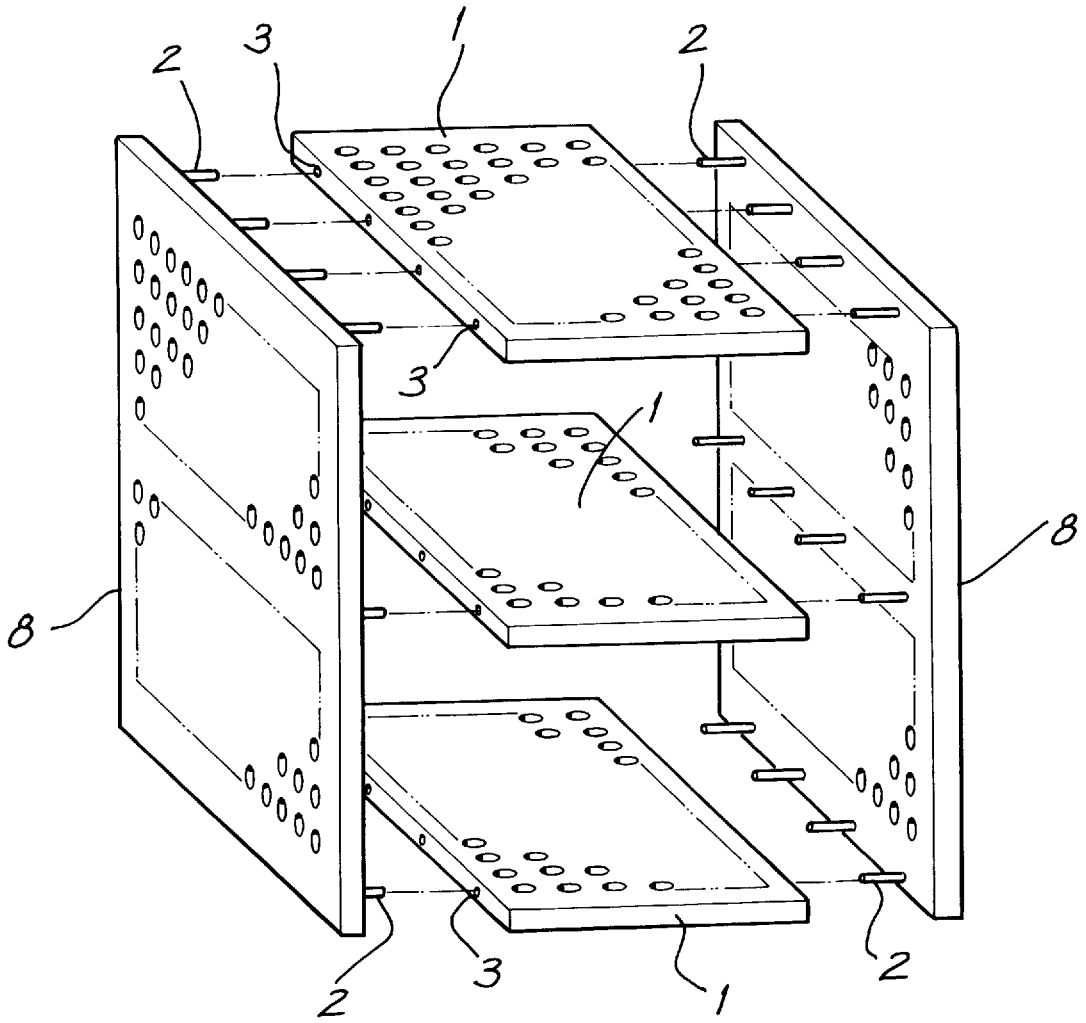
FIG. 4 illustrates a module of a pipe of one embodiment of the present invention.

One embodiment is shown in FIG. 4 in which a section of pipe (4) is made up of perforated concrete wall modules (8) having projections (2) which mate within recesses (3) in the inner transverse wall modules (1). Modules of the piping are placed together and wrapped in geofabric.

While any porous material such as concrete can be used, the embodiment shown in FIG. 1 comprises plastic pipes (4) having perforated double walls (8) to provide structural strength and permeability with a layer of geotextile material (9) covering the entire perforated walls (8). The whole structure is surrounded by clean sand (10). In some circumstances not all the walls need to be perforated.

The embodiment shown in FIG. 2 utilizes three layers of four porous pipes (4) for each layer. The construction of the embodiment is similar to that of FIG. 1.

The drainage pipes as shown in FIG. 3 could be constructed from modules of drainage cells (11) as described hereafter with reference to FIG. 8. These cells (11) are laid beneath the shoulder (12) of a roadway (13). The drainage cell (11) is wrapped in geotextile material (9), which in turn is embedded in clean sand fill (10). The drainage cells (11) assist in carrying water to the holding tank (36), from where water gradually permeates (38) back into the groundwater.

Figure 5:
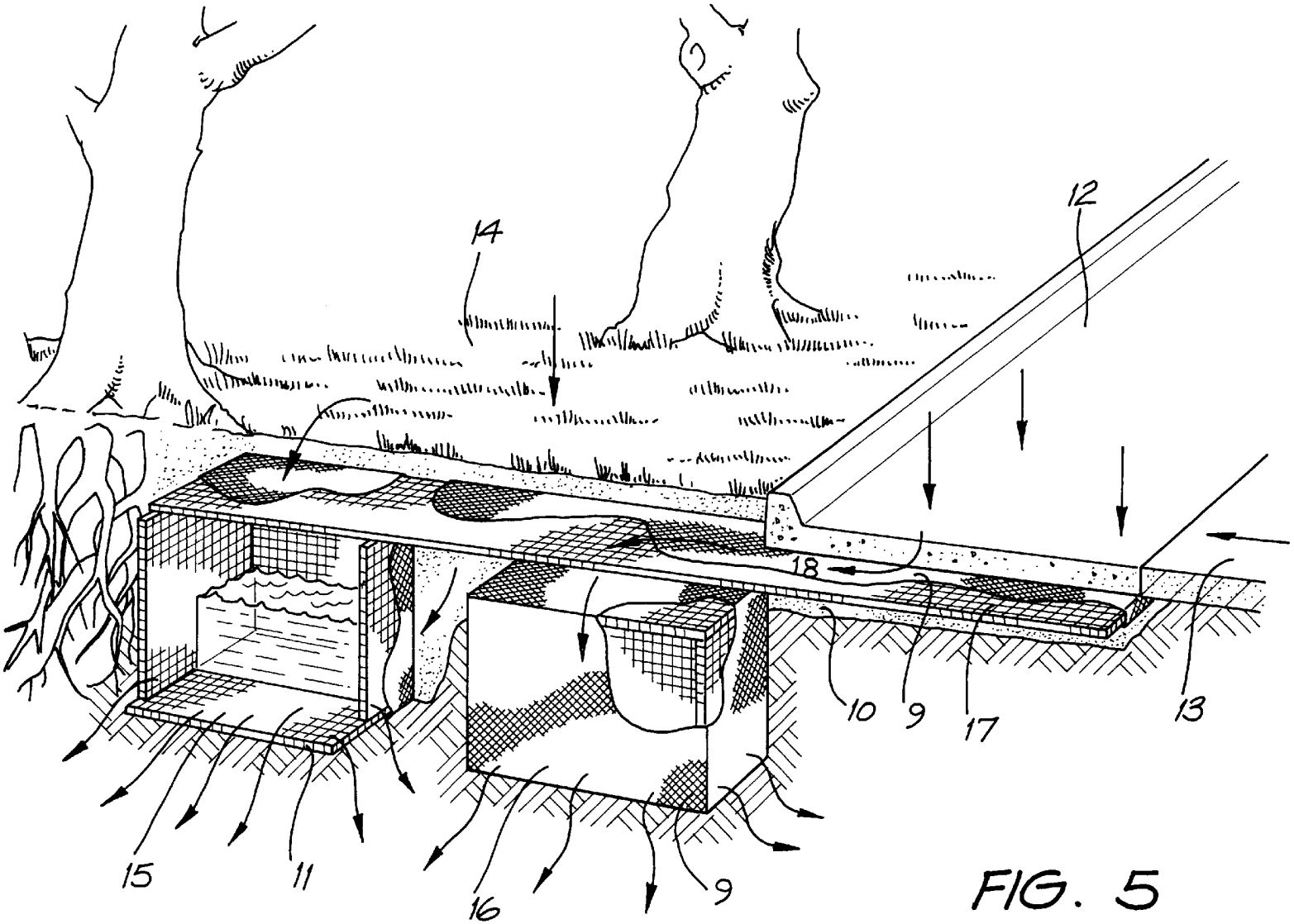
FIG. 5 illustrates a further embodiment of the present invention.

A variation of this construction is shown in FIG. 5 wherein the upper layer (17) of the double-walled drainage cell material (11) is coextensive with the road shoulder (12) although it lies beneath the road shoulder and extends beyond the road shoulder into the adjacent grassed area (14) and forms the upper surface of channel (15).

It may be observed that rectangular section channel (15) has a top and bottom wall and two side walls constructed from modules of double-walled drainage cell material (11) and is similarly surrounded by geotextile material (9) and clean sand fill (10).

A permeable or semipermeable tank (16) is also provided beneath the upper horizontal layer (17) of drainage cell material between the roadway (13) and channel (15). This tank is rectangular and is constructed of double-walled drainage cell material surrounded by geotextile material and embedded in clean sand. It will be observed that runoff (not shown) from the roadway (13) will flow onto shoulder (12) due to the camber of the road and then filter down through the permeable shoulder and geotextile material into the void between the two walls of drainage cell material (1). This water may then flow through the upper layer (17) of the drainage cell material in the direction depicted by arrow (18) into the adjacent grassed area (14). In the event that a large downpour is encountered resulting not only in runoff from the road but also saturation of grassed area (14), then the runoff from the road will fill firstly holding tank (16) and then, once holding tank (16) becomes full, channel (15).

Tank (16) will hold water and then slowly allow the water to permeate the surrounding ground. Runoff is therefore contained in an area immediately adjacent that in which it originated and may slowly percolate down through the layers of soil after the initial rain.

In the situation where more runoff is created than can be held by tank (16), then channel (15) accepts further runoff and initially acts as a secondary tank. Channel (15) is however provided with some fall as is the case with conventional stormwater channels so that excessive wetting of the area depicted in FIG. 6 which exceeds the capacity of tank (16) may result in runoff being transported to an adjacent area (not shown) by channel (15).

Channel (15) is however essentially different from existing stormwater channels in that water contained therein has firstly been filtered prior to entry into the channel and secondly may exit from the channel through the water permeable walls of the channel at the first available location where the surrounding ground is not saturated. In this manner clean water is distributed to the nearest adjacent non-saturated location to where the runoff originated.

Figure 6:
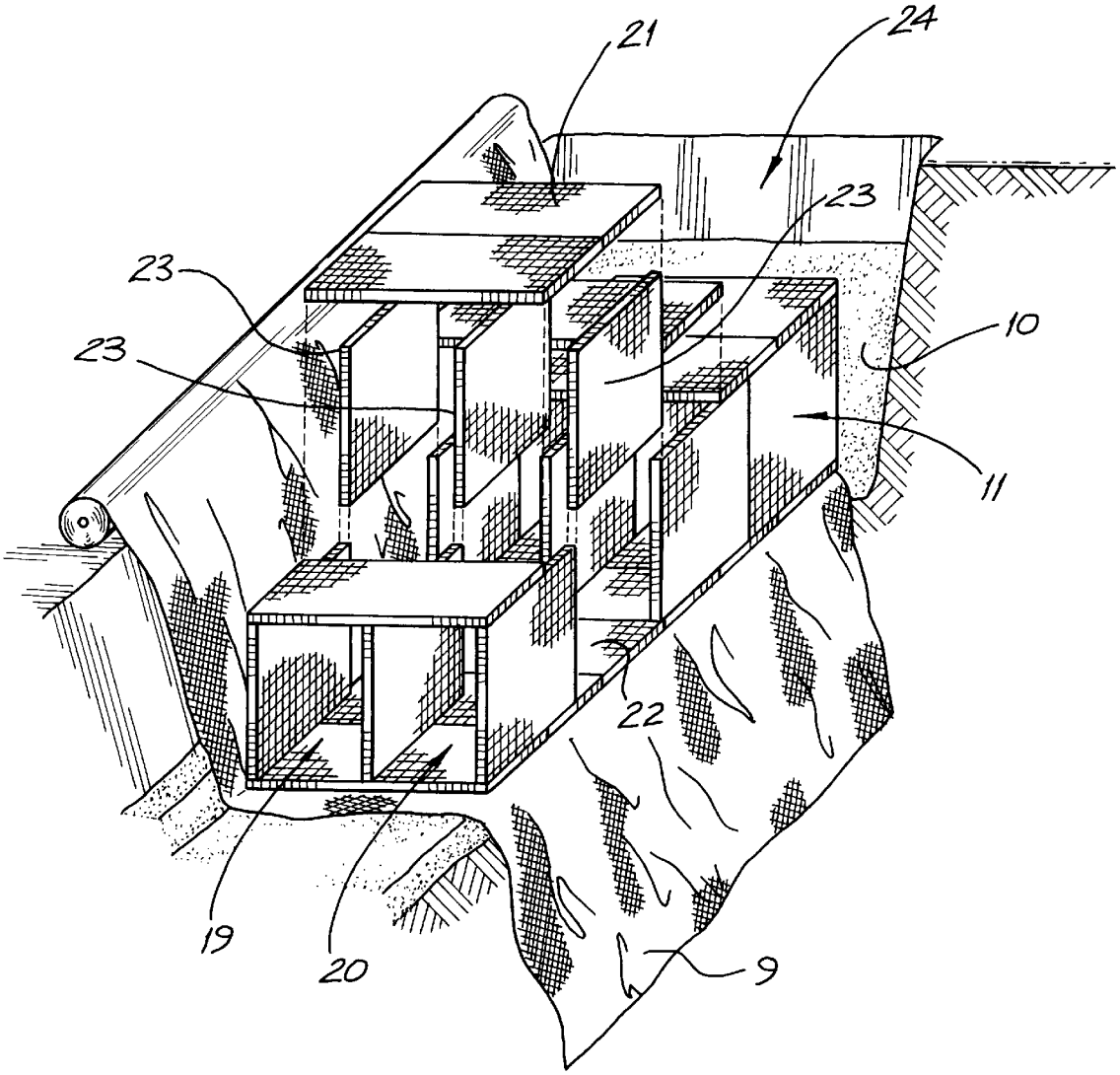
FIG. 6 illustrates a schematic view of a filter space constructed of discrete modules in accordance with one embodiment of the present invention.

FIG. 6 depicts a method of constructing a drainage channel utilizing discrete planar drainage cells (11) to form individual modules having two chambers (19) and (20) therein. It will be appreciated that each module is comprised of a roof (21), a floor (22), and three vertical sides (23). By placing modules end to end and joining them with joining members (not shown), the open-ended modules may be formed into a conduit of indefinite length. As will be appreciated from FIG. 1, the conduit formed by the modules is placed in a trench (24) which has previously been lined with clean sand (10) and geotextile material (9). After full assembly of the conduit and the complete wrapping in geotextile material (9), the trench (24) may be backfilled firstly with sand and then, if necessary, other material (not shown).

Figure 7:
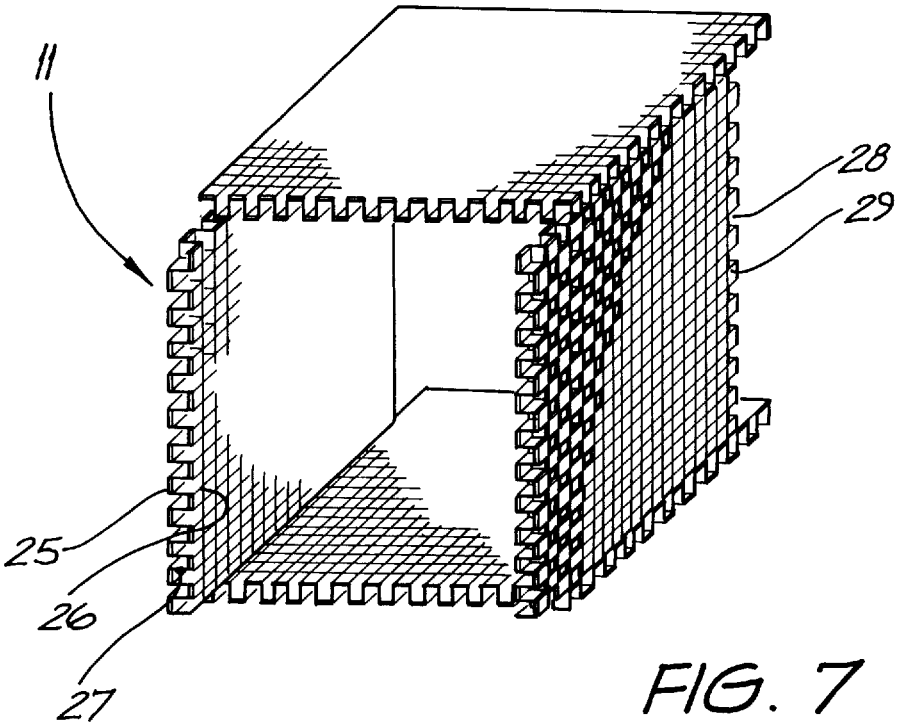
FIG. 7 illustrates a drainage cell module suitable for construction of embodiments of the present invention.

One form of a drainage cell is shown in FIG. 7, where the drainage cell (11) is constructed from parallel planar spaced-apart walls (25) and (26) with bracing members (27) interposed therebetween. In this example, the apertures (28) in each of walls (25) and (26) are substantially rectangular and are arranged in a checkerboard fashion alternating with substantially rectangular planar load-bearing sections (29) of similar size. These load-bearing sections are well adapted to support geotextile material. In this embodiment of drainage cell material, the apertures (28) in one of the sides are out of register with the apertures in the opposing side, hence providing a baffling effect to water passing therethrough. Such a product may be injection molded from plastic materials.

The channel modules could be formed of any material, with the walls of any desired thickness having perforations of any desired size.

Preferably the channel modules have two opposed open sides, but could be totally enclosed.

Figure 8A:
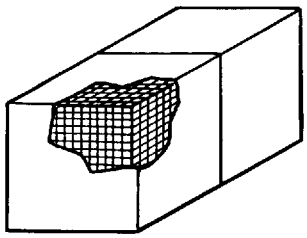
FIGS. 8*a*, 8*b* and 8*c* illustrate some shapes of tanks or channels according to some embodiments of the present invention.
Figure 8B:
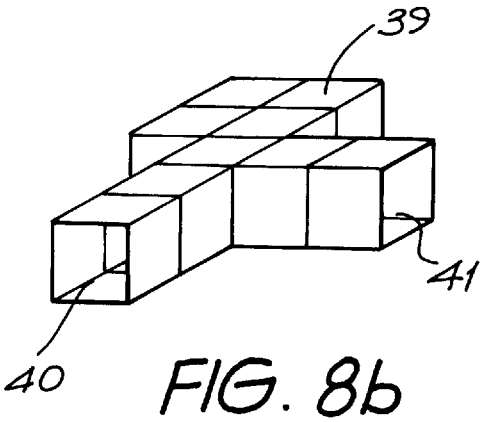
Figure 8C:
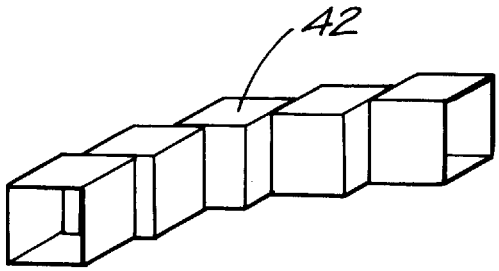
Figure 9:
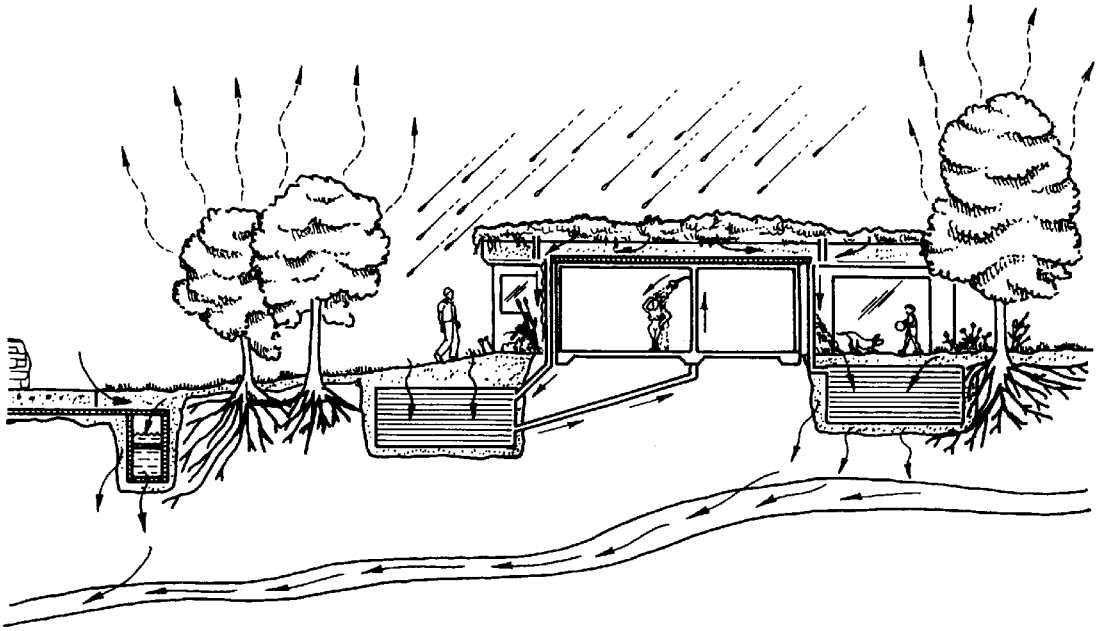
FIG. 9 shows a total water management system for a house utilizing embodiments of the present invention.

The tanks or piping of embodiments of the present invention can come in modular format and as many modules as desired can be fitted together to form a pipe as in FIG. 8*a* or a tank (39) with two pipes (40) and (41) as shown in FIG. 8*b* or as a curved pipe (42) as shown in FIG. 8*c*.

Figure 11:
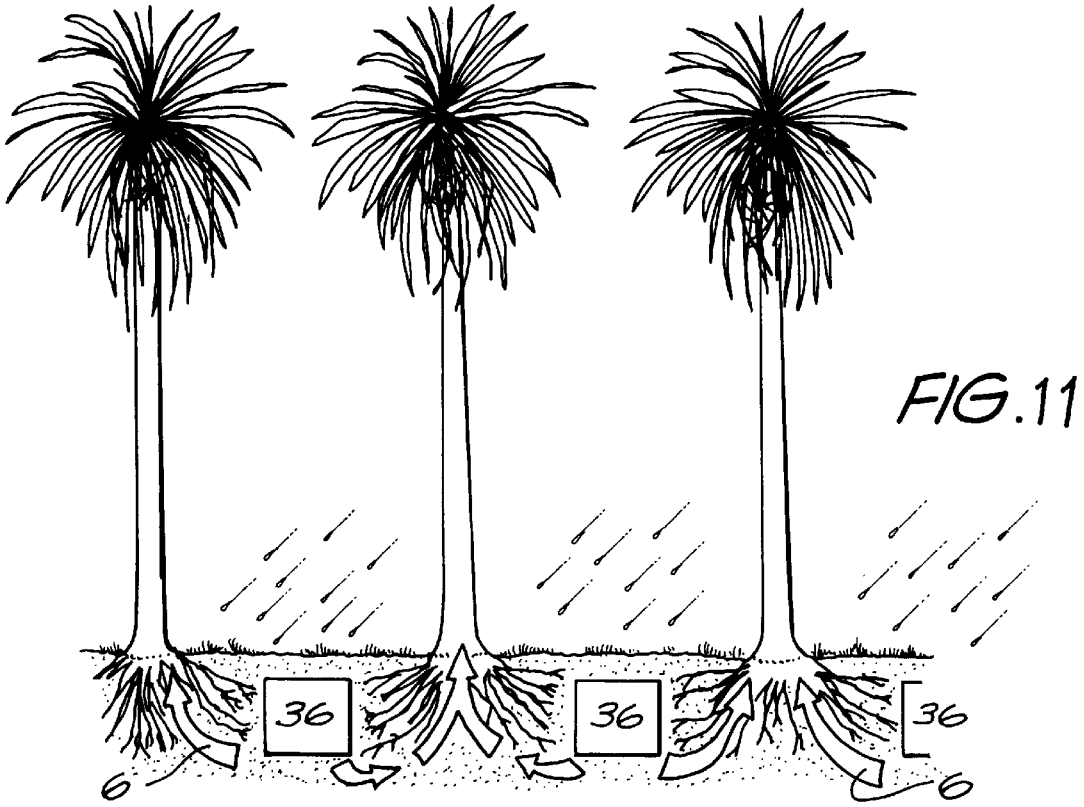

As shown in FIG. 11, the utilization of an embodiment of the present invention greatly increases the collection of rainwater that falls on site. Water is collected either from direct absorption through the ground or being channelled to permeable tanks from hard surface areas.

Figure 10:
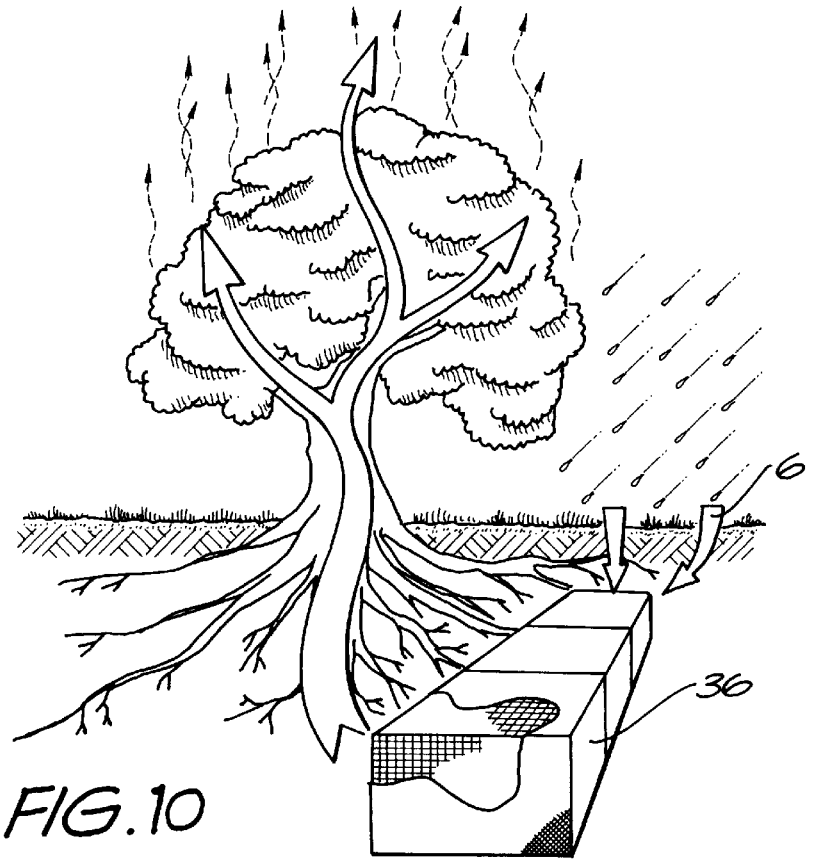
FIGS. 10 and 11 illustrate schematically the use of a holding tank to irrigate trees in parks and median strips.

The use of percolation or holding tanks (36) allows for the gradual permeation of clean water back into the water table as shown in FIGS. 10 and 11, where holding tanks (36) collect water runoff, to be slowly released to the soil adjacent trees or the like to ensure adequate watering thereof.

Figure 13:
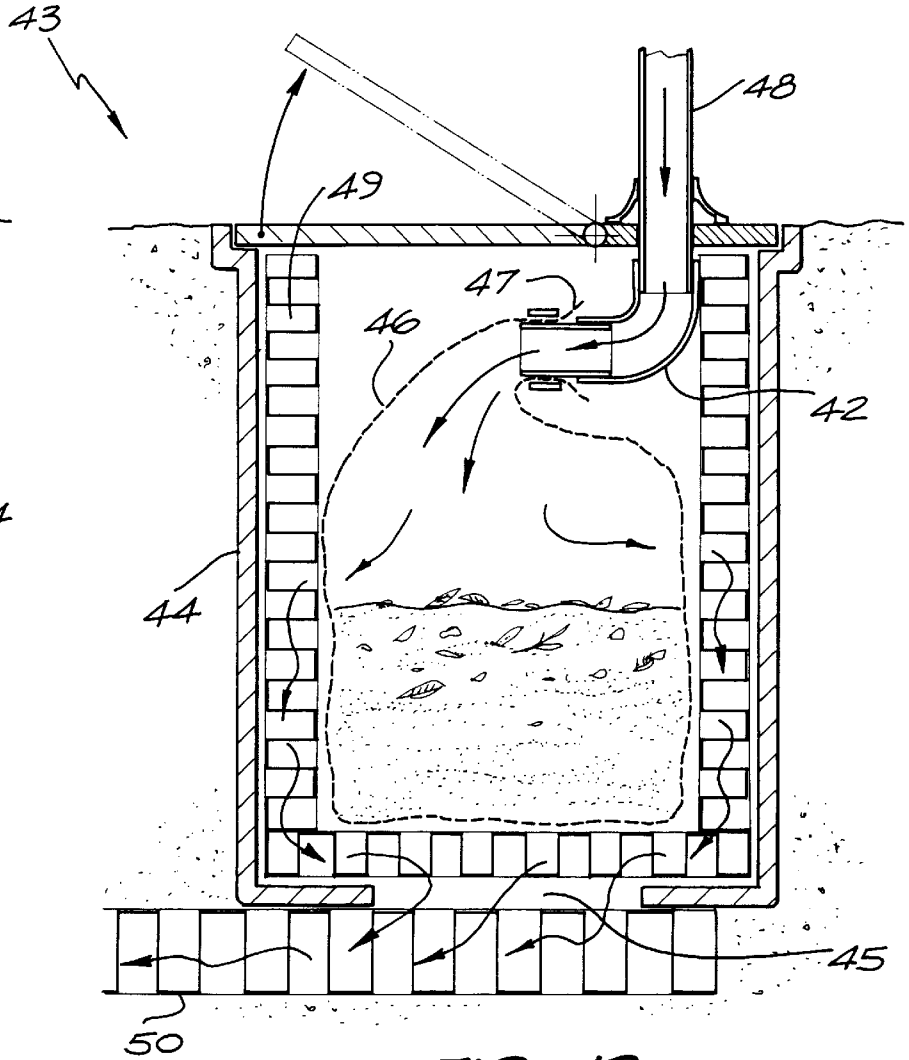
FIG. 13 illustrates a side view of the silt collection tank of FIG. 12.
Figure 12:
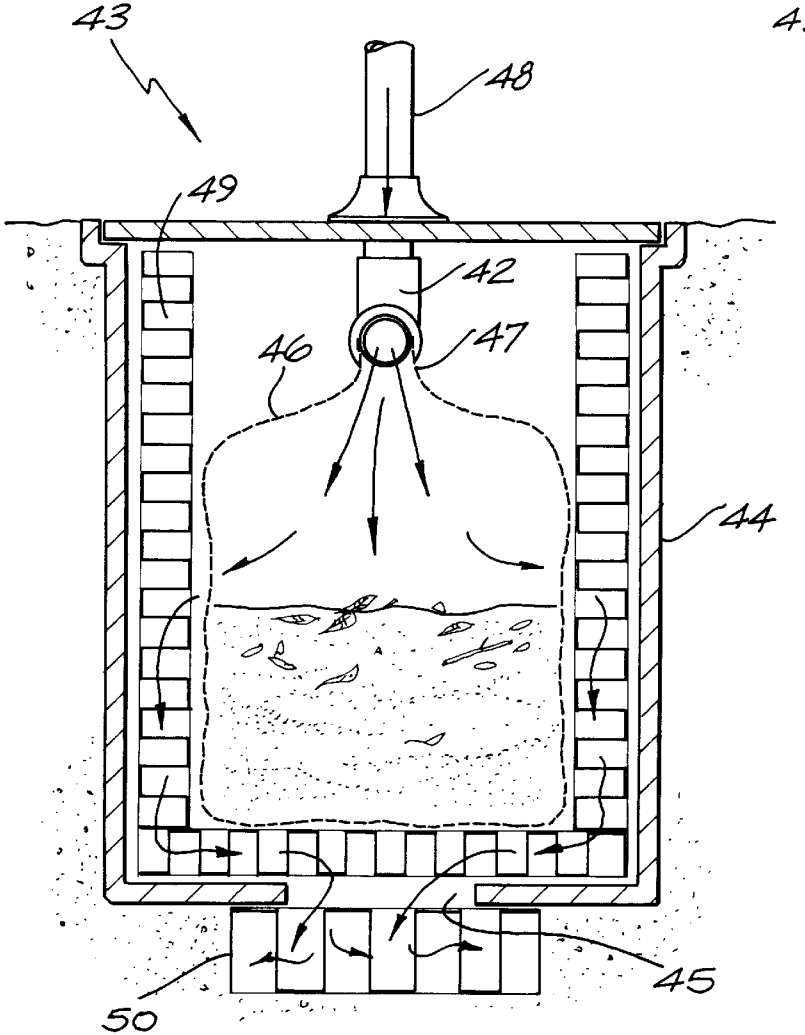
FIG. 12 illustrates one view of a silt collection tank according to one embodiment of the present invention.
Figure 14:
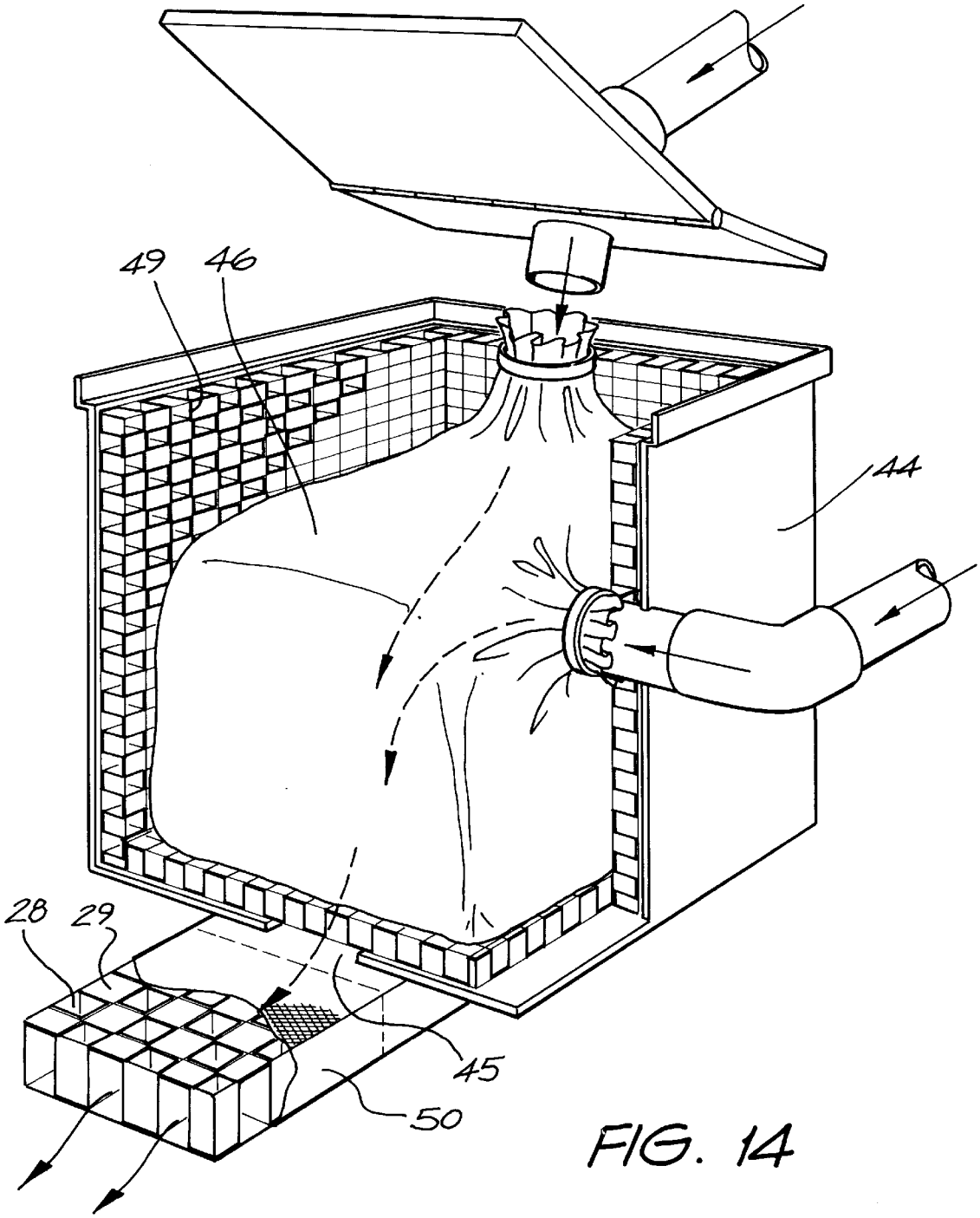
FIG. 14 illustrates a modification of the silt collection tank of FIGS. 12 and 13.

As shown in FIGS. 12, 13 and 14, a silt or rubbish collection tank (43) can be utilized to feed runoff into the storage/piping system. In this case an impervious container (44) is buried in the ground and has an opening (45) located at its base, communicating with a filter pipe (45) which has two opposed planar walls having apertures (28) and load-bearing sections (29). The apertures (28) of one wall are out of registry with the apertures of the opposed wall. This filter pipe (45) is wrapped in a geotextile material (9).

Lining the base and walls of the container (44) are modules of drainage cells (49) such as those described in FIG. 7. A geotextile bag (46) sits within the container (44) and its open end (43) is connected to an inlet pipe (48).

Hence, runoff containing silt and rubbish flows into the bag (46) where the silt and rubbish are retained and the filtered water flows through the drainage cells (49) into the filter pipe (45). As shown in FIG. 14, the filter pipe (45) could be made of discrete pipe sections (50).

The present invention therefore provides a drainage collection system which retains and distributes rainwater in an area as close as possible to the area of the rainfall.

It should be obvious that modifications or alterations could be made to the above-described invention without departing from the spirit or scope of the present invention.

What is claimed is:

1. An underground drainage system comprising:

modular wall panels having two planar spaced-apart surfaces including perforations and a plurality of rigid spacer members therebetween maintaining said surfaces in a fixed spatial relationship to each other, said modular wall panels being connected together to form a floor, roof and outer walls of storage and distribution units; and a water permeable geotextile wrapped around the storage and distribution units to cover all of the perforations.

2. An underground drainage system according to claim 1, wherein the perforations of each of the two planar spaced-apart surfaces are out of registry with the perforations of the other surface.

3. An underground drainage system according to claim 2 wherein the storage and distribution units have a layer of sand surrounding the geotextile.

4. An underground drainage system according to claim 2 wherein internal walls in the storage and distribution units are formed by said modular wall panels.

5. An underground drainage system according to claim 1, wherein piping connected to the storage and distribution units is formed by said modular wall units connected end to end and wrapped in geotextile.

6. An underground drainage system according to claim 1 further comprising:

a silt trap including a water impervious container defined by inner walls and a base having an opening therein;

a layer of said modular wall panels lining the inner walls and the base of the container and defining a passageway in communication with the opening in the base of the container;

a bag of water permeable geotextile supported on the modular wall panels; and an inlet pipe connected to said bag such that solids carried by water into said bag are retained in said bag and filtered water passes along the passageway defined by the modular wall panels and out through the opening in the base of the container.

7. An underground drainage system according to claim 6 wherein the opening in the base is connected to piping formed by said modular walls connected end to end and wrapped in geotextile.

8. A silt trap comprising:

a water impervious container including inner walls and a base having an opening therein;

a layer of modular wall panels having two planar spaced-apart perforated surfaces with a plurality of rigid spacer members therebetween maintaining said surfaces in a fixed spatial relationship to each other, the layer lining the inner walls and the base of the container and defining a passageway in communication with the opening in the base of the container;

a bag of water permeable geotextile supported on the modular wall panels; and an inlet pipe connected to said bag such that solids carried by water into said bag are retained in said bag and filtered water passes along the passageway defined by the modular wall panels and out through the opening in the base of the container.

* * * * *